United States Patent [19]

Grosch

[11] 4,422,514

[45] Dec. 27, 1983

[54] PUMP FOR A REVERSE CIRCULATION ROTARY DRILLING RIG

[76] Inventor: Wayne A. Grosch, R.R. #2, Osceola, Nebr. 68651

[21] Appl. No.: 305,915

[22] Filed: Sep. 28, 1981

[51] Int. Cl.[3] ..... E21B 21/00

[52] U.S. Cl. ..... 175/213; 175/217; 175/324

[58] Field of Search ..... 175/217, 213, 324; 415/219 C, 501

[56] References Cited

U.S. PATENT DOCUMENTS

| | | | |
|---|---|---|---|
| 1,424,362 | 8/1922 | Krogh | 415/501 |
| 3,024,853 | 3/1962 | Herbold | 175/313 |
| 3,300,950 | 1/1967 | Carle | 415/501 X |
| 3,945,771 | 3/1976 | Arakawa | 415/219 C X |

*Primary Examiner*—Stephen J. Novosad
*Assistant Examiner*—Joseph Falk
*Attorney, Agent, or Firm*—Zarley, McKee, Thomte, Voorhees & Sease

[57] ABSTRACT

A pump for a reverse circulation rotary drilling rig is described which is designed to prevent drilling fluid from coming into contact with the pump bearing. A generally cylindrical-shaped housing is secured to the lower end of the Kelly bar and is in fluid communication with the interior thereof. The housing defines first and second spaced-apart compartment areas having a fluid passageway extending therebetween at one side of the housing. A rotatable shaft extends downwardly through the Kelly bar, through the first compartment area, through the space between the compartment areas and into the second compartment area. An impeller is mounted in the second compartment area and is designed, upon rotation of the shaft, to pump drilling fluid upwardly through the pipe string, outwardly through the second compartment area, through the fluid passageway and the first compartment area upwardly through the Kelly bar. A bearing is operatively secured to the housing within the first compartment area for rotatably supporting the shaft. A tube extends downwardly through the Kelly bar around the shaft and has its lower end extending around the bearing to isolate the bearing and the shaft from the drilling fluid which could cause damage to the bearing if the fluid came into contact with same.

4 Claims, 2 Drawing Figures

PUMP FOR A REVERSE CIRCULATION ROTARY DRILLING RIG

BACKGROUND OF THE INVENTION

This invention relates to a pump and more particularly to a pump for a reverse circulation rotary drilling rig.

Rotary drilling rigs are commonly used to drill water wells or the like and normally comprise a rotatable Kelly bar having the drilling pipe secured to the lower end thereof. In reverse circulation drilling rigs, the drilling fluid is pumped upwardly through the interior of the pipe string and upwardly through the Kelly bar for subsequent recirculation downwardly through the drill hole outwardly of the pipe string. Conventional reverse circulation drilling rigs employ a primed vacuum system to circulate the drilling fluid upwardly through the drill bit, Kelly bar and Kelly hose. Severe problems are associated with the vacuum systems due to the difficulty in priming and with winter freeze-ups. Further, the priming operation requires considerable time. Applicant has solved the problems normally associated with the conventional reverse circulation systems by mounting a submerged centrifugal pump at the lower end of the Kelly bar. However, the submersion of the pump causes drilling fluid to come into contact with the bearing supporting the pump shaft which greatly reduces the life of the bearing.

Therefore, it is a principal object of the invention to provide a unique pump for a reverse circulation rotary drilling rig.

A further object of the invention is to provide a pump of the type described including means for preventing the drilling fluid from coming into contact with the bearing which supports the pump shaft.

A further object of the invention is to provide a pump including means for fluidly isolating the shaft bearing from the fluid being pumped.

A still further object of the invention is to provide a pump of the type described which is durable in use and easy to service, if necessary.

These and other objects will be apparent to those skilled in the art.

SUMMARY OF THE INVENTION

A pump for use with a reverse circulation rotary drilling rig is disclosed including a generally cylindrical-shaped housing having an upper discharge opening in communication with the lower end of a Kelly bar. The lower end of the housing is provided with an inlet opening which is in communication with the Kelly bar and the pipe string respectively. A fluid passageway is provided in the housing at one side thereof to provide communication between the compartment areas. A rotatable shaft extends downwardly through the Kelly bar and through the upper and lower compartment areas. An impeller is mounted on the shaft in the lower compartment area for pumping fluid upwardly through the pipe string and upwardly through the Kelly bar. A bearing is secured to the housing in the upper compartment area for rotatably supporting the shaft which extends therethrough. A pipe extends downwardly through the Kelly bar and embraces the shaft. The lower end of the pipe extends around the bearing and fluidly isolates the bearing from the fluid passing through the upper compartment area.

DESCRIPTION OF THE PREFERRED EMBODIMENT

Figure 1:
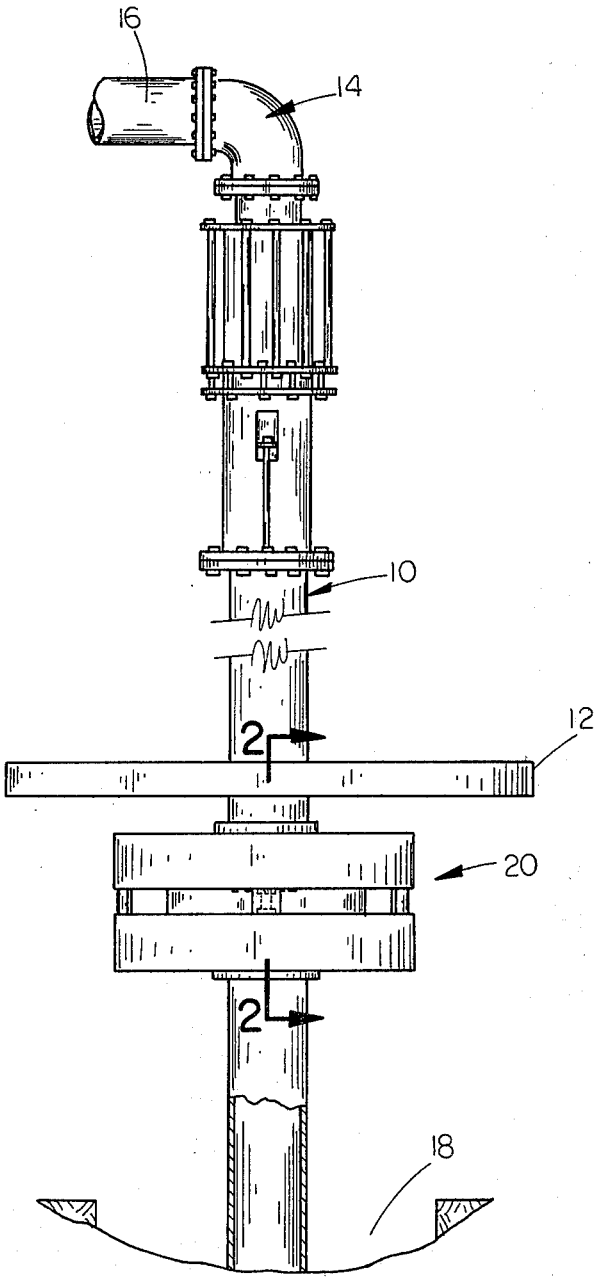
FIG. 1 is an elevational view illustrating the pump of this invention in association with a rotary drilling rig Kelly bar.

In FIG. 1, the numeral 10 refers generally to a Kelly bar normally found on a conventional rotary drilling rig. The lower end of the Kelly bar 10 has a bar means 12 mounted thereon which is adapted to be received by the drilling rig turntable. The numeral 14 refers generally to a swivel means which connects the upper end of the Kelly bar to a laterally extending pipe 16. Pipe 16 extends to conventional means for returning the drilling fluid or circulating fluid to the drill hole 18 outwardly of the Kelly bar and drilling pipe string.

Figure 2:
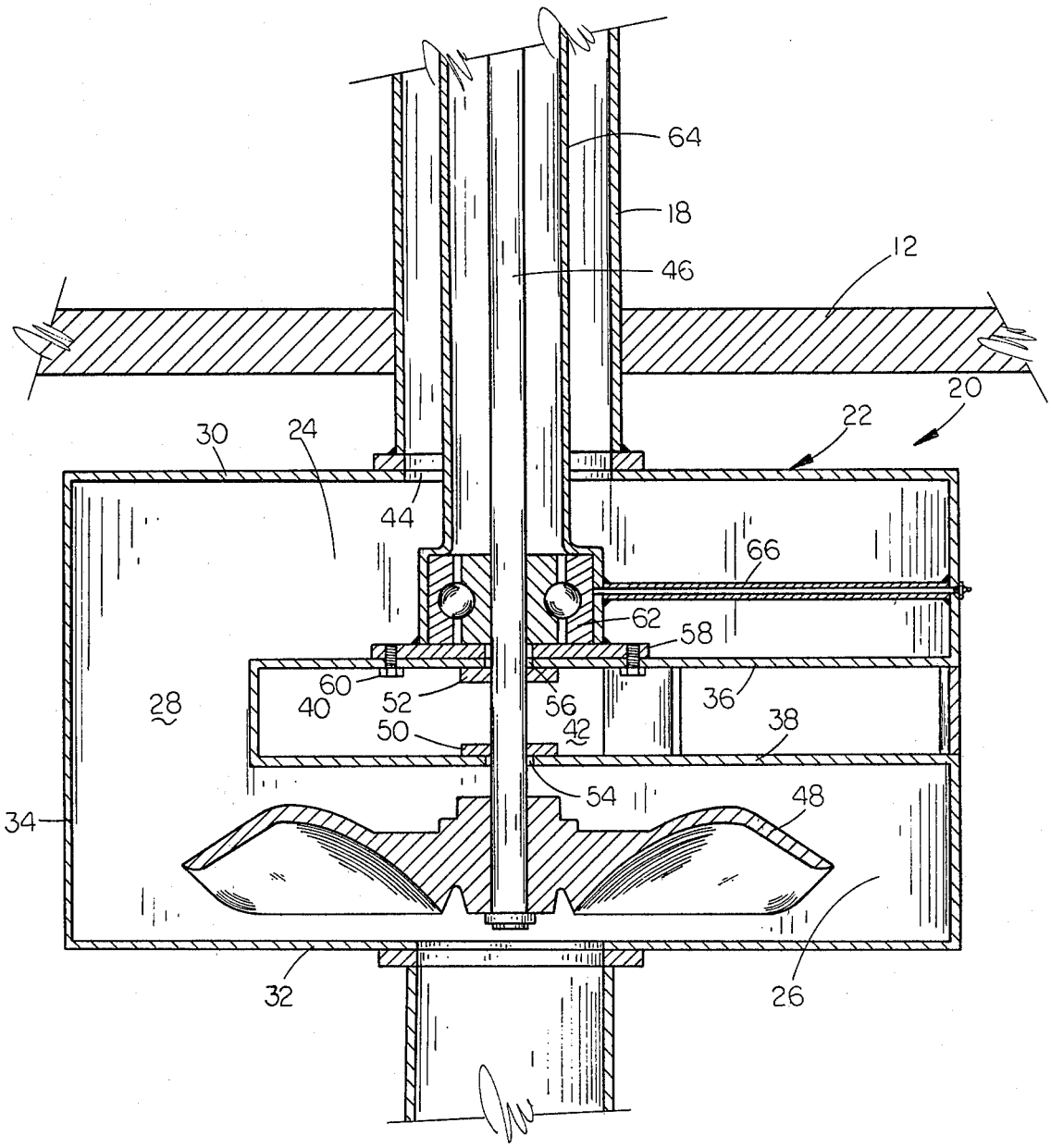
FIG. 2 is a sectional view of the pump as seen on lines 2—2 of FIG. 1.

The numeral 20 refers generally to the submerged centrifugal pump of this invention which is secured to the Kelly bar adjacent the lower end thereof as will be described in more detail hereinafter. Pump 20 comprises a generally cylindrical-shaped housing 22 which defines spaced-apart upper and lower compartment areas 24 and 26 respectively. Housing 22 also includes a fluid passageway 28 which extends between the compartment areas 24 and 26. For purposes of description, housing 22 will be described as including a top wall 30, bottom wall 32, and side wall 34. Housing 22 is also provided with intermediate wall portions 36 and 38 which are spaced-apart as illustrated in FIG. 2 and which extend inwardly from one side of the housing to a vertically disposed wall 40 which extends therebetween. For purposes of description, the walls 36, 38 and 40 define a space 42 between the upper and lower compartment areas 24 and 26.

Top wall 30 of housing 22 is provided with a discharge opening 44 formed therein which communicates with the lower interior of the Kelly bar 10 as illustrated in FIG. 2. Rotatable shaft 46 extends downwardly through the interior of the Kelly bar, through compartment area 24, space 42 and into compartment area 26. Shaft 46 is rotated by any convenient conventional means. An impeller 48 is mounted on shaft 46 in compartment area 26 and is designed to pump circulating fluid upwardly through the pipe string into compartment area 26, through passageway 28, through compartment area 24 and upwardly through the interior of the Kelly bar 10.

The numerals 50 and 52 refer to slinger rings or collars which are mounted on the shaft 46 in space 42. Slinger ring 50 rotates with the shaft 46 and is designed to laterally sling or fling any drilling fluid which may pass upwardly through the opening 54. Likewise, the slinger ring 52 is designed to laterally sling or fling any drilling fluid coming into contact therewith to prevent drilling fluid from entering the opening 56.

Plate 58 is secured to wall 36 by bolts 60 and supports the bearing 62 as illustrated in FIG. 2. Bearing 62 embraces shaft 46 to provide the necessary rotatable bearing support for the shaft 46. The numeral 64 refers to a pipe or tube which extends downwardly through the Kelly bar around the shaft 46 to fluidly isolate the shaft 46 from the drilling fluid passing upwardly through the Kelly bar. The lower end of the pipe 64 embraces the bearing 62 as illustrated in FIG. 2 and is secured by welding or the like to the plate 58. The welding of the lower end of the pipe 64 to the plate 58 prevents drilling fluid in compartment area 24 from coming into contact with the bearing. A grease tube 66 is in communication with the bearing 62 and the exterior of the housing as illustrated to permit the bearing to be greased.

In use, the pump 20 is lowered into the drill hole 18 and is submerged in the drilling put in the hole 18. The submersion of the centrifugal pump 20 eliminates the priming operation normally associated with the first circulation drilling rigs. The sumberged centrifugal pump of this invention also does away with all vacuum problems which are normally a tremendous problem on reverse circulation rigs. The pump of this invention eliminates all priming paraphernalia normally found on reverse circulation rigs and which eliminates wintertime freeze-ups in the priming liner. Further, the fact that the pump 20 is submerged enables the rig to achieve instant circulation.

Thus it can be seen that a novel pump has been provided which not only provides a means for adequately supporting the rotating pump shaft 46 but which provides a means for preventing drilling fluid from coming into contact with the bearing 62. Inasmuch as the drilling fluid and cuttings carried thereby are prevented from coming into contact with the bearing 62, the bearing will experience a much longer field life. Thus it can be seen that the pump accomplishes at least all its stated objectives.

I claim:

1. A pump for a reverse circulation drilling rig, including a hollow Kelly bar having upper and lower ends, a generally cylindrical-shaped housing having upper and lower ends, said housing having a central discharge opening formed in its upper end which communicates with the lower end of the Kelly bar, means securing the upper end of said housing to said Kelly bar, said housing having a central inlet opening formed in its lower end for receiving the drilling fluid being circulated, said housing defining spaced-apart first and second compartment areas, said housing having a fluid passageway at one side thereof which extends between said first and second compartment areas, a shaft rotatably mounted and extending downwardly through the Kelly bar, through said first compartment area and into said second compartment area, a pump impeller means on said shaft in said second compartment area for pumping fluid inwardly through said inlet opening, outwardly from said second compartment area, through said fluid passageway and said first compartment area and upwardly through said Kelly bar, a bearing means operatively secured to said housing in said first compartment area embracing said shaft, a pipe means extending downwardly through the Kelly bar positioned around said shaft for preventing fluid from coming into contact with said shaft, the lower end of said pipe means enclosing said bearing means in said first compartment area for preventing fluid in said first compartment area from coming into contact with said bearing means, and means extending from said housing for connection to drilling pipe.

2. The pump of claim 1 wherein a grease tube extends inwardly from said housing to said pipe means for lubricating said bearing means.

3. The pump of claim 1 wherein said spaced-apart compartment areas define a space therebetween through which said shaft extends, and a slinger means mounted on said shaft in said space for preventing drilling fluid from entering the interior of said pipe means.

4. The pump of claim 1 wherein said pump is submerged in the drill hole.

* * * * *